US010750865B1

(12) United States Patent
Harper

(10) Patent No.: US 10,750,865 B1
(45) Date of Patent: Aug. 25, 2020

(54) PROTECTIVE COVER APPARATUS FOR FURNITURE

(71) Applicant: Roxane Deborah Harper, Livermore, CA (US)

(72) Inventor: Roxane Deborah Harper, Livermore, CA (US)

(73) Assignee: R Deborah Enterprises, LLC, Henderson, NV (US)

( * ) Notice: Subject to any disclaimer, the term of this patent is extended or adjusted under 35 U.S.C. 154(b) by 0 days.

(21) Appl. No.: 16/545,959

(22) Filed: Aug. 20, 2019

Related U.S. Application Data

(60) Provisional application No. 62/721,082, filed on Aug. 22, 2018.

(51) Int. Cl.
*A47B 95/04* (2006.01)

(52) U.S. Cl.
CPC ..... *A47B 95/043* (2013.01)

(58) Field of Classification Search
CPC ..... A47C 31/10; A47C 31/11; B65D 81/3886; B65D 1/06; B41J 29/13; F24F 13/20; F24F 1/58
USPC ..... 108/27, 90; 150/158, 165, 154
See application file for complete search history.

(56) References Cited

U.S. PATENT DOCUMENTS 1,240,208 A * 9/1917 Holtmeyer ..... A47B 13/08 108/90
2,490,250 A * 12/1949 Boener ..... A47J 27/00 150/154
3,181,176 A * 5/1965 Nagy ..... A47K 17/00 4/353
4,117,782 A * 10/1978 Cahill ..... A47B 95/043 108/27
4,750,402 A * 6/1988 Markey ..... G10G 7/005 108/90
4,962,709 A * 10/1990 Huber ..... B60N 3/001 108/27
5,199,415 A * 4/1993 Johnson, Jr. ..... F24B 1/198 108/27
5,474,185 A * 12/1995 Franke ..... B65D 65/02 150/158
5,857,231 A * 1/1999 Wade ..... A45F 3/22 150/154
6,050,419 A * 4/2000 Flanagan ..... B65D 71/0096 206/597
6,260,487 B1 * 7/2001 Giorgio ..... B65D 19/38 108/51.11
6,408,768 B1 * 6/2002 Giampavolo ..... B65D 19/38 108/27

(Continued)

*Primary Examiner* — Jose V Chen

(57) ABSTRACT

A protective cover apparatus that disposes around a furniture member is provided. The apparatus includes a pair of deformable panels coupled together. Each panel has an outer covering with an inner cavity and an inner assembly disposed therein. Each outer covering in the pair of panels has a front face, a rear face, a top face, a bottom face and a pair of side faces. The first side face of the first panel is coupled to one of the pair of side faces in the second panel, and the second side face of the first panel is coupled to another one of the pair of side faces in the second panel to form a connected panel assembly. The connected panel assembly is disposed around the furniture member so that the pair of panels conform to and extend along the perimeter of the furniture member.

8 Claims, 5 Drawing Sheets

(56) References Cited

U.S. PATENT DOCUMENTS

| | | | | |
|---|---|---|---|---|
| 6,543,864 | B2 * | 4/2003 | Cline | A47B 43/04 150/165 |
| 6,708,941 | B1 * | 3/2004 | Bowen | A47B 95/043 108/27 |
| 7,377,515 | B2 * | 5/2008 | Barker | A47B 25/00 108/11 |
| 8,424,467 | B2 * | 4/2013 | Giampavolo | B65D 19/38 108/51.11 |
| 8,789,475 | B1 * | 7/2014 | Giampavolo | B65D 19/38 108/27 |
| 2005/0274298 | A1 * | 12/2005 | Paulin | A47B 13/083 108/90 |
| 2006/0236897 | A1 * | 10/2006 | Pofeldt | A47B 13/083 108/27 |
| 2007/0051282 | A1 * | 3/2007 | Huang | A47B 13/12 108/27 |
| 2007/0090259 | A1 | 4/2007 | Chen | |
| 2009/0189045 | A1 | 7/2009 | Peckovich | |
| 2013/0134640 | A1 * | 5/2013 | Thaxton | F16F 1/376 267/140 |
| 2013/0327457 | A1 * | 12/2013 | Mark | A47J 36/06 150/165 |
| 2019/0008300 | A1 * | 1/2019 | Graber | B65D 81/3876 |

* cited by examiner

PROTECTIVE COVER APPARATUS FOR FURNITURE

RELATED APPLICATION

The application claims priority to provisional U.S. patent application Ser. No. 62/721,082 filed on Aug. 22, 2018, the entire contents of which is herein incorporated by reference.

BACKGROUND

The embodiments herein relate generally to padding and covers for furniture.

Furniture commonly has sharp corners and/or edges, especially tables including coffee tables, eating tables, work tables and the like. These tables present in the home or office pose safety risks. In particular, toddlers, children, elderly individuals and others can fall on the sharp corners and/or edges of the tables and injure themselves.

Several protective covers for furniture exist as disclosed in U.S. Pat. No. 4,117,782, and U.S. Patent Application Publications 2009/0189045 and 2007/0090259. However, these protective covers are limited for at least the following reasons: (1) the cover only partially covers the furniture member and exposes other potentially sharp or dangerous surfaces; (2) the cover does not easily conform to different shaped furniture members without resizing and/or cutting the components; and/or (3) the cover does not allow the efficient removal, replacement and/or interchange of its components to accommodate user preferences.

As such, there is a need in the industry for a protective cover apparatus for use with furniture members that addresses the limitations of the prior art, which provides a cover apparatus that extends across the entire perimeter of the furniture item to minimize the exposure of any sharp corners and/or edges. There is a further need for the cover apparatus to be deformable and resilient to allow it to conform to different shaped furniture members. There is a need for the cover apparatus to allow a user to easily remove, replace and/or interchange any of its components.

SUMMARY

In certain embodiments, a protective cover apparatus configured to dispose around a perimeter of a furniture member to absorb impacts with other objects and enclose sharp portions present on the furniture member is provided. The protective cover apparatus comprises a pair of deformable panels coupled together, each panel in the pair of panels comprising an outer covering with an inner cavity and an inner assembly disposed therein, each outer covering in the pair of panels comprising a front face, a rear face, a top face connecting the front and rear faces together, a bottom face connecting the front and rear faces together, and a pair of side faces connecting the front and rear faces together, wherein the first side face of the first panel in the pair of panels is coupled to one of the pair of side faces in the second panel in the pair of panels, and the second side face of the first panel is coupled to another one of the pair of side faces in the second panel to form a connected panel assembly, wherein the connected panel assembly is configured to dispose around the furniture member so that the pair of panels conform to and extend along the perimeter of the furniture member.

In one embodiment, each inner assembly in the pair of panels comprises a board, a cushion layer coupled to the board, and a cover layer disposed entirely around the board and cushion layer.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

In certain embodiments as depicted in FIGS. 1-4, the protective cover apparatus is disposed around a furniture member such as table 50, and comprises a pair of panels 10 that couple together and conform to and extend along the perimeter of table 50. This allows the protective cover apparatus to serve as a barrier that minimizes and/or eliminates the exposure of any sharp corners and/or edges on table 50. It shall be appreciated that table 50 can be any type of table with various shapes. In alternative embodiments, the protective cover apparatus can be used with other types of furniture members.

Figure 6:
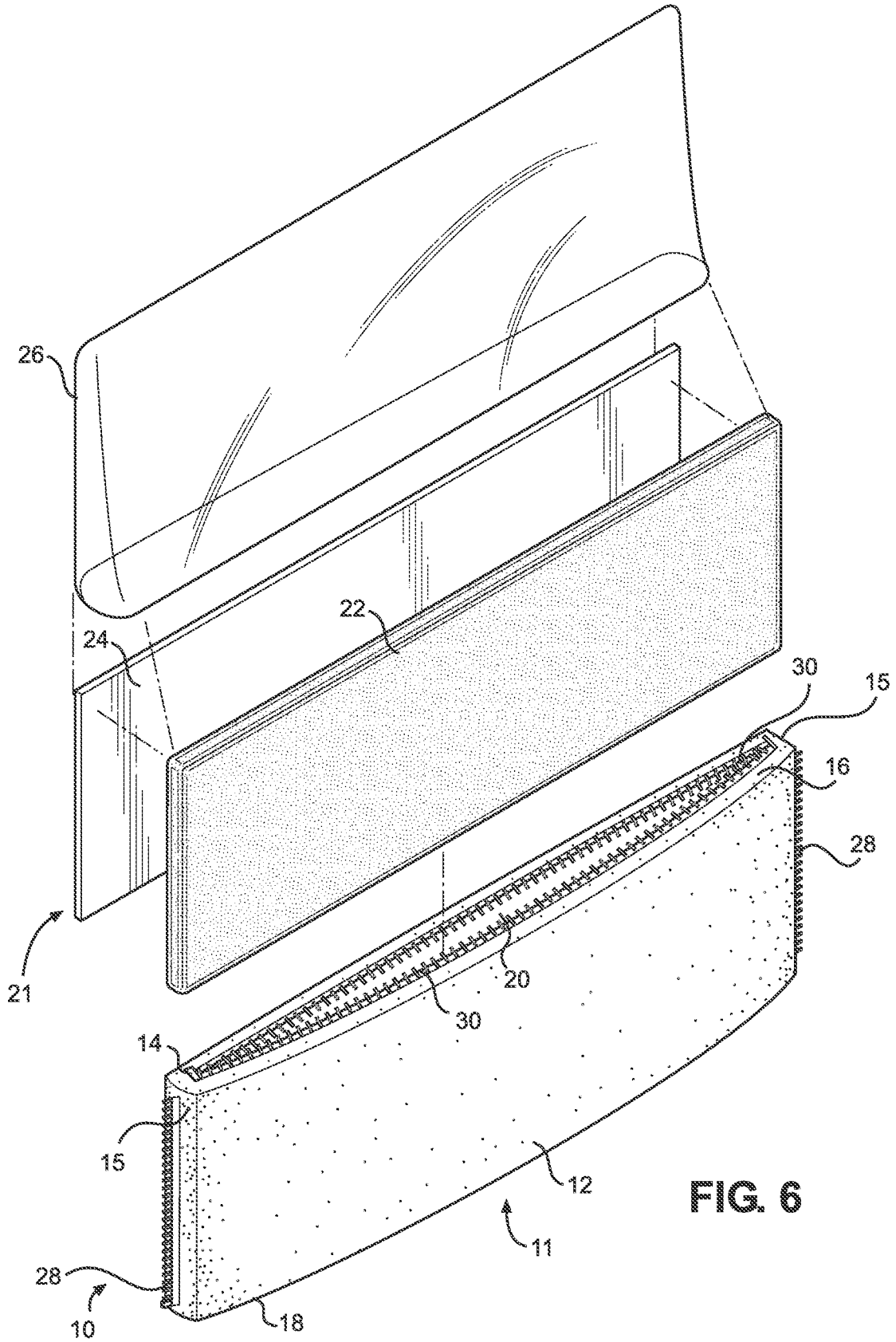
FIG. 6 depicts an exploded view of certain embodiments of the protective cover apparatus.

In certain embodiments as depicted in FIGS. 1-5, the protective cover apparatus comprises a pair of panels 10 coupled together. In a preferred embodiment as depicted in FIG. 6, each panel 10 comprises outer covering 11 and inner assembly 21. Outer covering 11 comprises front face 12, rear face 14, a pair of side faces 15, top face 16 and bottom face 18 connected together. In one embodiment, outer covering 11 is made from any material such as fabric or other materials, which can have any colors, decorations and the like.

In one embodiment, top face 16 of panel 10 comprises slit 20 that is sealable by fastening member 30. Slit 20 extends along top face 16 and provides access to the inner cavity of panel 10. Fastening member 30 can be any fastening component including, but not limited to, zippers, snap fasteners, hook and loop fasteners and tie fasteners. In one exemplary embodiment, fastening member 30 is a zipper as depicted in FIGS. 3-6. In an alternative embodiment, it shall be appreciated that slit 20 and fastening member 30 can be present on bottom face 18 of panel 10 instead.

Each side face 15 of panel 10 comprises fastening member 28, which can be any fastening component including, but not limited to, zipper, snap fastener, hook and loop fastener and tie fastener components.

In one embodiment as depicted in FIG. 6, inner assembly 21 is configured to insert through slit 20 in outer covering 11 and be housed within panel 10. In one embodiment, inner assembly 21 comprises cushion layer 22, board 24 and cover layer 26. Cushion layer 22 is coupled to board 24 by an adhesive or alternative fastening component. In one embodiment, cushion layer 22 comprises any deformable and resilient material or combination of materials including, but not limited to, foam including memory foam, egg carton foam and the like, cotton balls or other types of fillers. Board 24 can be made from any semi-rigid material that provides structure to panel 10 while allowing it to bend as needed. In one embodiment, board 24 comprises any material including, but not limited to, STYROFOAM board, wood, cardboard, poster board, plastic board, and the like.

In one embodiment, cover layer 26 is disposed entirely around cushion layer 22 and board 24. Cover layer 26 is secured in place around cushion layer 22 and board 24 by stitching, snap components, hook and loop fasteners, tie fasteners, staples or other fastening components. In a preferred embodiment, cover layer 26 is any generally slippery material with reduced friction including, but not limited to, silk, polyester, plastic, CELLOPHANE or other materials.

In operation, the pair of panels 10 of the protective cover apparatus is coupled together. This is accomplished by securing fastening member 28 on each side face 15 of panel 15 with fastening member 28 on one of side faces 15 on the other panel 10. This forms a connected panel assembly that can be disposed around table 50 as depicted in FIGS. 1-5. The deformable and resilient nature of the protective cover apparatus allows the pair of panels 10 to conform to and extend along the perimeter of table 50, regardless of the shape of the table or furniture member.

Figure 1:
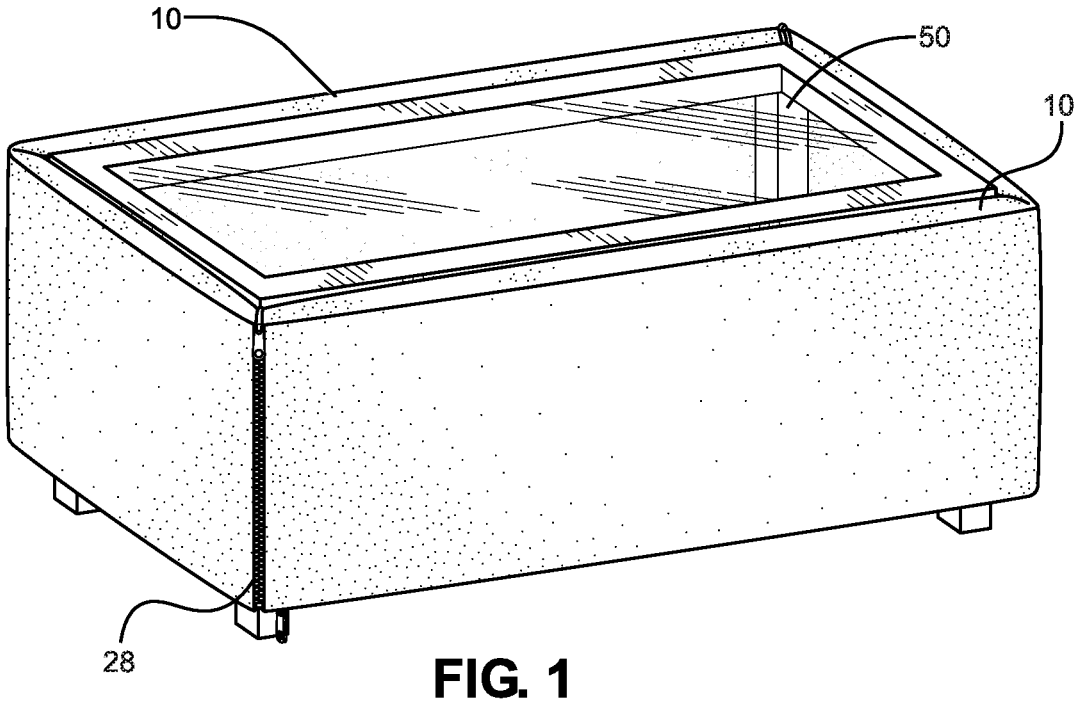
FIG. 1 depicts a perspective view of certain embodiments of the protective cover apparatus shown in use with a first table.
Figure 2:
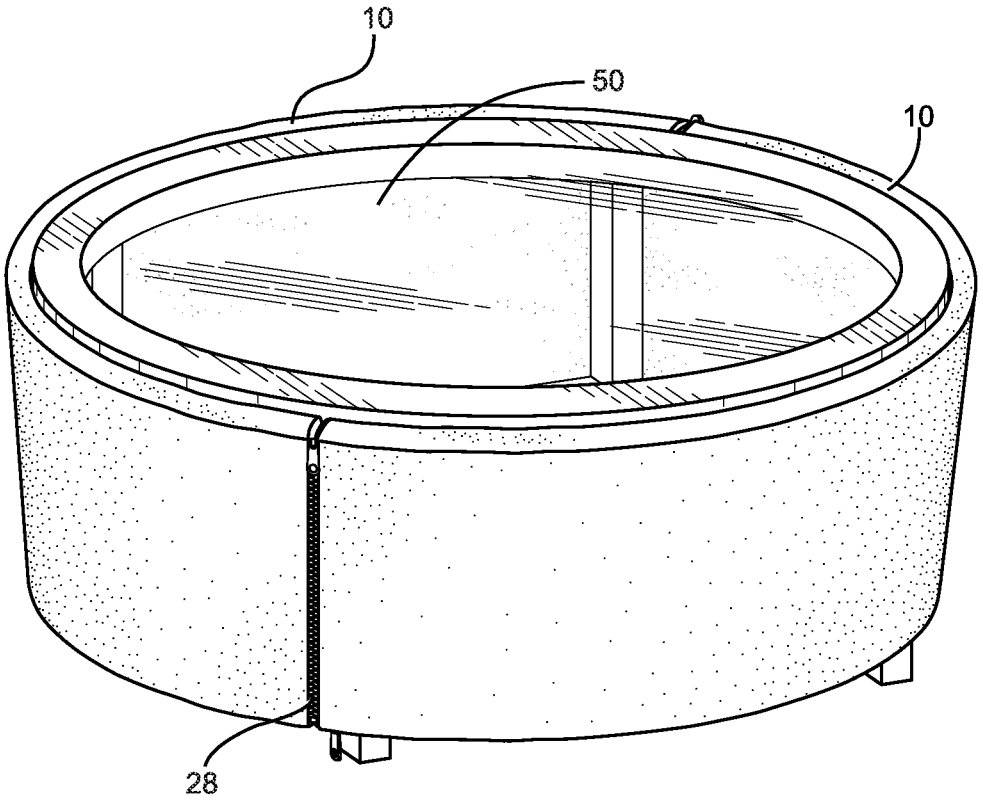
FIG. 2 depicts a perspective view of certain embodiments of the protective cover apparatus shown in use with a second table.
Figure 3:
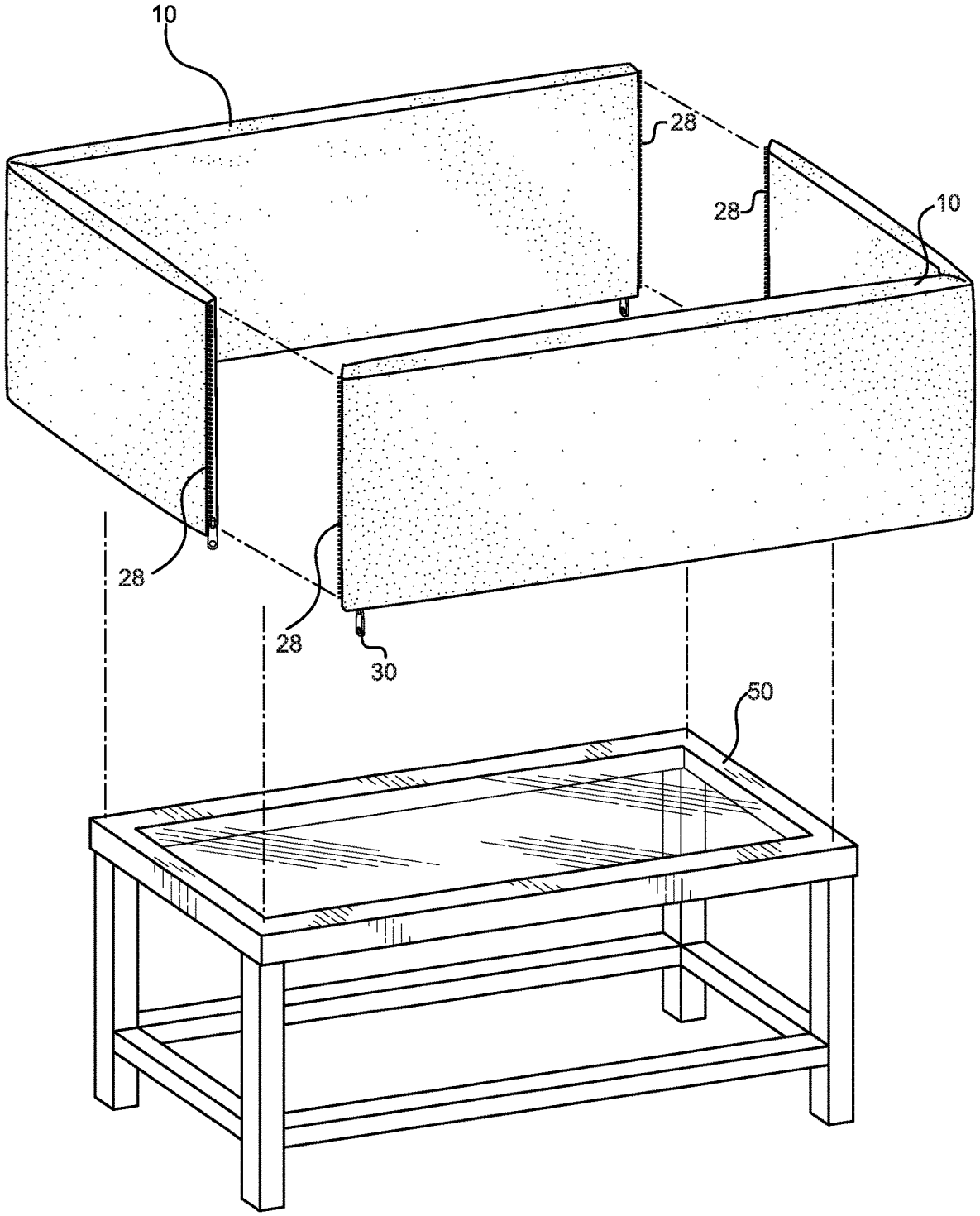
FIG. 3 depicts an exploded view of certain embodiments of the protective cover apparatus in use with the first table.
Figure 4:
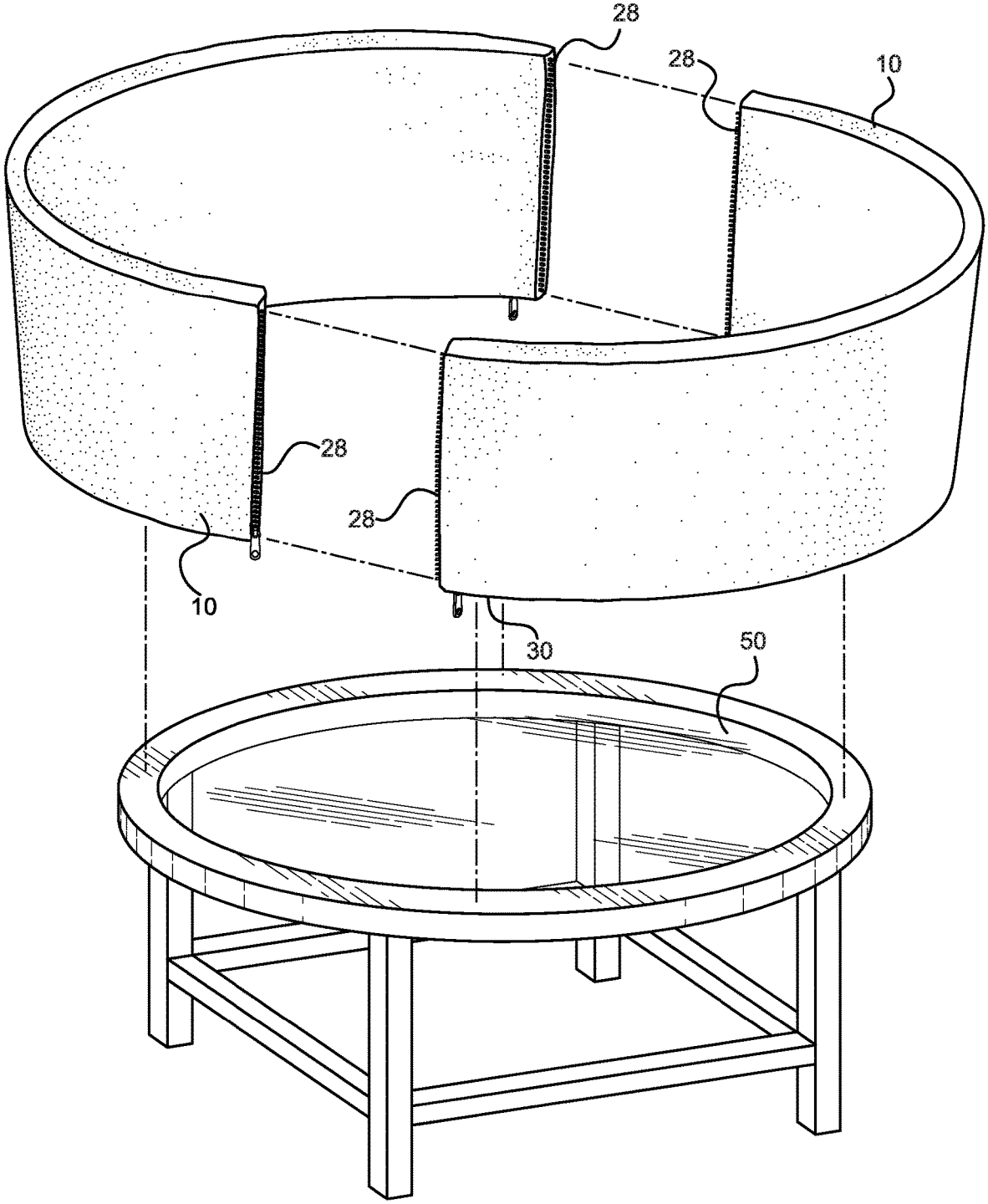
FIG. 4 depicts an exploded view of certain embodiments of the protective cover apparatus in use with the second table.
Figure 5:
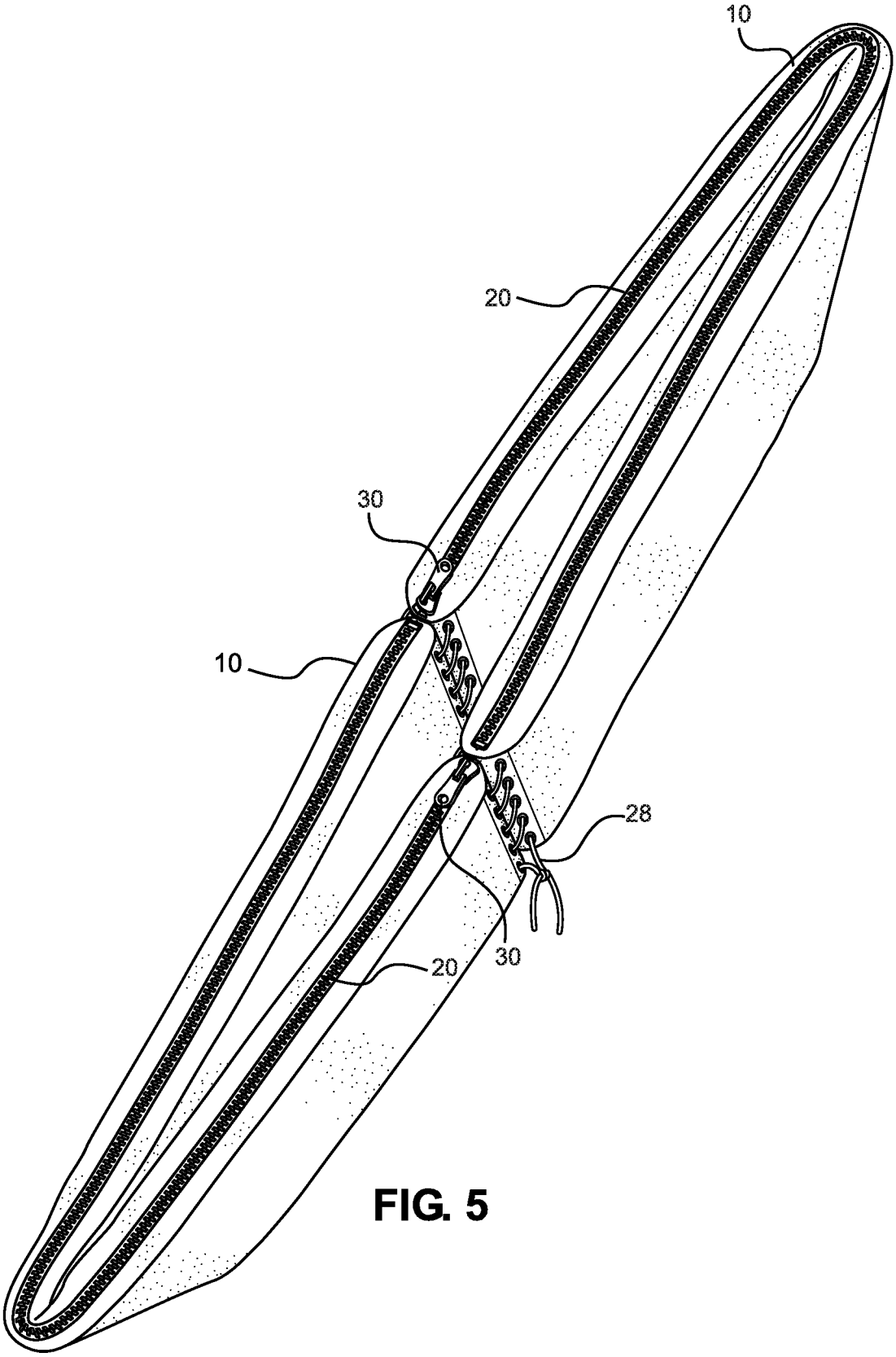
FIG. 5 depicts a top perspective view of certain embodiments of the protective cover apparatus illustrating the apparatus in a folded configuration.

As depicted in FIGS. 1-2, the protective cover apparatus extends along the entire perimeter of table 50 to cover any sharp edges and/or corners on the table. In an alternative embodiment, the protective cover apparatus may comprise any additional number of panels 10 with variable dimensions that can be connected together in the same manner described to form a connected panel assembly that conforms to user specifications.

Panels 10 of the protective cover apparatus can be removed from table 50 as needed. The user can maneuver fastening component 30 as needed to open or close slit 20 on each panel 10. When slit 20 is open, the user can remove and insert inner assembly 21 as desired. The slippery material of cover layer 26 allows inner assembly 21 to easily slide in and out of the inner cavity of panel 10. This is advantageous because it allows a user to easily replace or interchange any of the components of the protective cover apparatus as desired.

It shall be appreciated that the components of the protective cover apparatus described in several embodiments herein may comprise any alternative known materials in the field and be of any color, size and/or dimensions. It shall be appreciated that the components of the protective cover apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A protective cover apparatus configured to dispose around a perimeter of a furniture member to absorb impacts with other objects and enclose sharp portions present on the furniture member, the protective cover apparatus comprising:

a pair of deformable panels coupled together, each panel in the pair of panels comprising an outer covering with an inner cavity and an inner assembly disposed therein, each outer covering in the pair of panels comprising a front face, a rear face, a top face connecting the front and rear faces together, a bottom face connecting the front and rear faces together, and a pair of side faces connecting the front and rear faces together, each panel in the pair of panels comprising a sealable slit on the bottom face of the panel to permit access to the inner assembly in the inner cavity of the panel;

wherein the first side face of the first panel in the pair of panels is coupled to one of the pair of side faces in the second panel in the pair of panels, and the second side face of the first panel is coupled to another one of the pair of side faces in the second panel to form a connected panel assembly, wherein the connected panel assembly is configured to dispose around the furniture member so that the pair of panels conform to and extend along the perimeter of the furniture member.

2. The protective cover apparatus of claim 1, wherein each inner assembly in the pair of panels comprises a board, a cushion layer coupled to the board, and a cover layer disposed entirely around the board and cushion layer.

3. The protective cover apparatus of claim 2, wherein each pair of side faces coupled together in the pair of panels is secured together by a first fastening member.

4. The protective cover apparatus of claim 3, wherein the first fastening member is selected from the group consisting of a zipper, snap fastener, hook and loop fastener and tie fastener.

5. The protective cover apparatus of claim 3, further comprising a second fastening member coupled to the sealable slit on each panel in the pair of panels, the second fastening member configured to adjust to an open position to permit access to the inner cavity of the panel and a closed position to seal the inner cavity of the panel.

6. The protective cover apparatus of claim 5, wherein the second fastening member is selected from the group consisting of a zipper, snap fastener, hook and loop fastener and tie fastener.

7. A method of covering sharp portions present on a perimeter of a furniture member, the method comprising:

providing a protective cover apparatus, the protective cover apparatus comprising:

a pair of deformable panels, each panel in the pair of panels comprising an outer covering with an inner cavity and an inner assembly disposed therein, each outer covering in the pair of deformable panels comprising a front face, a rear face, a top face connecting the front and rear faces together, a bottom face connecting the front and rear faces together, and a pair of side faces connecting the front and rear faces together, each panel in the pair of panels comprising a sealable slit on the bottom face of the panel to permit access to the inner assembly;

connecting the first side face in the first panel in the pair of panels with the first side face in the second panel in the pair of panels;

connecting the second side face in the first panel in the pair of panels with the second side face in the second panel in the pair of panels;

disposing the connected pair of panels around the furniture member so that the pair of panels conform to and extend along the perimeter of the furniture member; and maneuvering the sealable slit on any one of the pair of panels to remove the inner assembly from the panel.

8. The method of claim 7, wherein the inner assembly of the protective cover apparatus comprises a board, a cushion layer coupled to the board, and a cover layer disposed entirely around the board and cushion layer.

* * * * *